US007693456B2

(12) United States Patent
Narita et al.

(10) Patent No.: US 7,693,456 B2
(45) Date of Patent: Apr. 6, 2010

(54) CONDUCTIVE MEMBER AND PROCESS CARTRIDGE HAVING IT AND IMAGE FORMING APPARATUS HAVING THE PROCESS CARTRIDGE

(75) Inventors: Yutaka Narita, Sagamihara (JP); Makoto Nakamura, Ebina (JP); Akiko Tanaka, Atsugi (JP); Taisuke Tokuwaki, Sagamihara (JP); Tadayuki Oshima, Atsugi (JP); Hiroki Furubayashi, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 479 days.

(21) Appl. No.: 11/340,533

(22) Filed: Jan. 27, 2006

(65) Prior Publication Data

US 2006/0188293 A1 Aug. 24, 2006

(30) Foreign Application Priority Data

Jan. 27, 2005 (JP) ..... 2005-019517

(51) Int. Cl.
*G03G 15/02* (2006.01)
*G03G 21/18* (2006.01)
*G03G 15/08* (2006.01)
*G03G 15/20* (2006.01)

(52) U.S. Cl. ..... 399/176; 399/115; 399/121; 399/313

(58) Field of Classification Search ..... 399/115, 399/121, 176, 313
See application file for complete search history.

(56) References Cited

U.S. PATENT DOCUMENTS 5,576,805 A * 11/1996 Ishihara et al. ..... 399/176
5,600,420 A * 2/1997 Saito et al. ..... 399/302
5,848,340 A * 12/1998 Enomoto et al. ..... 399/303
7,340,200 B2 * 3/2008 Kosuge ..... 399/176
2002/0051654 A1 * 5/2002 Niimi et al. ..... 399/159
2002/0106224 A1 * 8/2002 Yamauchi et al. ..... 399/313
2003/0072587 A1 * 4/2003 Sugiura et al. ..... 399/176
2003/0175046 A1 * 9/2003 Namiki et al. ..... 399/176
2003/0180071 A1 * 9/2003 Suda ..... 399/159

(Continued)

FOREIGN PATENT DOCUMENTS

JP 63-149668 6/1988

(Continued)

OTHER PUBLICATIONS

U.S. Appl. No. 11/441,042, filed May 26, 2006, Narita, et al.

(Continued)

*Primary Examiner*—David M Gray
*Assistant Examiner*—Joseph S Wong
(74) *Attorney, Agent, or Firm*—Oblon, Spivak, McClelland, Maier & Neustadt, L.L.P.

(57) ABSTRACT

A conductive member including a conductive supporting body (1), an electric resistance adjusting layer (2) formed on the conductive supporting body (1), and space holding members (3, 3) provided on opposite ends of the electric resistance adjusting layer (2), at least one engaging projection (50, 60,70, 80) being provided on one of the electric resistance adjusting layer (2) and each of the space holding members (3, 3), and an engaging opening (51, 61, 71, 81) in which the engaging projection is inserted being provided in the other of the electric resistance adjusting layer (2) and each of the space holding members (3, 3).

16 Claims, 6 Drawing Sheets

U.S. PATENT DOCUMENTS

2005/0100365 A1 5/2005 Narita et al.

FOREIGN PATENT DOCUMENTS

| | | |
|---|---|---|
| JP | 1-267667 | 10/1989 |
| JP | 3-240076 | 10/1991 |
| JP | 4-358175 | 12/1992 |
| JP | 7-168417 | 7/1995 |
| JP | 2001-296723 | 10/2001 |
| JP | 2002-139893 | 5/2002 |
| JP | 2004-354477 | 12/2004 |
| JP | 2005-24830 | 1/2005 |
| JP | 2005-91818 | 4/2005 |

OTHER PUBLICATIONS

U.S. Appl. No. 11/620,365, filed Jan. 5, 2007, Oshima, et al.
U.S. Appl. No. 11/537,751, filed Aug. 13, 2007, Nakamura, et al.
U.S. Appl. No. 11/836,950, filed Aug. 10, 2007, Tokuwaki, et al.
U.S. Appl. No. 11/854,947, filed Sep. 13, 2007, Oshima, et al.
U.S. Appl. No. 12/044,521, filed Mar. 7, 2008, Oshima, et al.

* cited by examiner

CONDUCTIVE MEMBER AND PROCESS CARTRIDGE HAVING IT AND IMAGE FORMING APPARATUS HAVING THE PROCESS CARTRIDGE

CROSS-REFERENCE TO RELATED APPLICATIONS

This application is based on Japanese Patent Application Nos. 2004-19404 filed on Jan. 28, 2004 and 2005-019517 filed on Jan. 27, 2005, the contents of which are incorporated herein by reference.

BACKGROUND OF THE INVENTION

1. Field of the Invention

The present invention relates to a conductive member such as an electrification roller, a transfer roller or the like used in image forming apparatuses such as copying machines, laser beam printers, facsimiles or the like, a process cartridge using the conductive member and an image forming apparatus using the process cartridge.

2. Related Art Statement

A conductive member such as an electrification roller for applying an electrification process to a photoconductor drum or image carrier, or a transcription or transfer roller applying a transcription process to a toner image on the photoconductor drum has been used for a conventional electro photographic type-image forming apparatus such as an electro photographic type-copying machine, a laser beam printer, and a facsimile.

FIG. 14 illustrates a conventional electro photographic type-image forming apparatus having an electrification roller.

As shown in FIG. 14, the conventional electro photographic type-image forming apparatus 120 is composed of a photoconductor drum 101 on which an electrostatic latent image is formed, an electrification roller 102 contacting with the photoconductor drum 101 for carrying out an electrification process to the photoconductor drum 101, an exposure mechanism 103 for a laser beam or the like, a development roller 104 for transferring toner on the electrostatic latent image of the photoconductor drum 101, a power pack 105 to apply a DC voltage to the electrification roller 2, a transfer roller 106 for transferring the toner image on the photoconductor drum 101 to a recording paper 107, a cleaning device 108 for cleaning the photoconductor drum 101 after the toner image is transferred, a surface electrometer 109 for measuring a surface potential of the photoconductor drum 101.

The image forming apparatus 120 has a process cartridge detachable system. That is to say, the image forming apparatus 120 comprises a process cartridge 110 in which a process instrument including the photoconductor drum 101, the electrification roller 102, the development roller 104 and the cleaning device 108 is removably attached to a main body of the image forming apparatus.

The process cartridge 110 may include at least the photoconductor drum 101 and the electrification roller 102. The process cartridge 110 is mounted on a predetermined place of the image forming apparatus 120, thereby the process cartridge 110 is structured to be in connection with a drive system and an electric system of the image forming apparatus, which are not shown.

Meanwhile, a functional unit necessary for another electro photographic process conventionally is not required for the present invention, it is omitted in FIG. 14.

Next, a basic operation of the conventional image forming apparatus 20 of the electro photographic system is explained.

When a DC voltage is supplied from the power pack 105 to the transfer roller 102 contacting with the photoconductor drum 101, a surface of the photoconductor drum 101 is charged uniformly to a high electric potential. Immediately thereafter, when image light is irradiated to the surface of the photoconductor drum 101 by the exposure mechanism 103, the irradiated portion of the photoconductor drum 101 has a reduced potential. It is known that such an electrification mechanism on the surface of the photoconductor drum 101 by the electrification roller 102 is formed by a discharge according to the Paschen's Law based on a minute gap between the electrification roller 2 and the photoconductor drum 4.

Because image light is a distribution of light based on white/black of image, when the image light is irradiated to the photoconductor drum 101, a potential distribution or electrostatic latent image based on a recorded image is formed on a surface of the photoconductor drum 101 by the irradiation of the image light. In this way, when the portion of the photoconductor drum 101 where the electrostatic latent image is formed passes the development roller 104, toner is attached to the portion of the photoconductor drum depending to a high or low potential to expose the electrostatic latent image and form a visible image on the photoconductor drum. A recording paper 107 is sent in a predetermined timing to the portion of the photoconductor drum where the toner image is formed by a resist roller (not shown), and disposed to overlap the toner image on the photoconductor drum.

After the toner image is transferred on the recording paper 107 by the electrification roller 2, the recording paper 107 is separated from the photoconductor drum 101. The separated recording paper 107 is transported passing through a transportation path and ejected out of the image forming apparatus after it is heated by a fixing unit (not shown). In this way, when the transcription or transfer is completed, the surface of the photoconductor drum 101 is cleaned up by the cleaning device 108 and then a residual potential on the photoconductor drum is eliminated by a quenching lamp (not shown), and the photoconductor drum on which the potential is eliminated is prepared for the next image forming treatment.

For a conventional electrification system using an electrification roller, a contact-electrifying system is often used, in which the electrification roller is contacted with a photoconductor drum (see for reference JP-A-S63-149668 and JP-A-H01-267667).

However, there are some problems in the contact-electrifying system as follows.

(1) If a material used for the electrification roller seeps from the electrification roller, the seeped material is transferred and attached to a charged member, for example, a photoconductor drum and hence traces of the electrification roller remain on a surface of the charged member.

(2) When an alternating voltage is applied to the electrification roller, the electrification roller contacting with the charged member or photoconductor drum oscillates, resulting in an electrification noise.

(3) The toner on the photoconductor drum is attached to the electrification roller, thereby electrification performance is decreased. Especially, the toner is easy to attach to the electrification roller by the seeping of the material as mentioned above.

(4) The material for the electrification roller is easy to be attached onto the photoconductor drum.

(5) If the photoconductor drum is not driven for a long time, the electrification roller is permanently deformed.

In order to resolve the above problems, there has been proposed a proximity-electrifying system in which an electrification roller is disposed close to a photoconductor drum without contacting with the photoconductor drum (see for reference, JP-A-H03-240076 and JP-A-H04-358175). With this proximity-electrifying system, the electrification roller is disposed to face the photoconductor drum with the closest distance (within a range of 50 to 300 μm) and a voltage is applied to the electrification roller to charge the photoconductor drum.

However, because the electrification roller does not contact with the photoconductor drum in the proximity-electrifying system, there are no problems such as the attachment of the material of the electrification roller to the photoconductor drum and the permanent deformation of the electrification roller, which are caused by the contact-electrifying system.

In the electrification roller of the proximity-electrifying system disclosed in JP-A-H03-240076 and JP-A-H04-358175, spacer ring members are provided in opposite sides of the electrification roller to hold a gap between the electrification roller and the photoconductor drum.

However, because an improvement for setting the gap accurately is not made for the electrification roller of the proximity-electrifying system, the gap varies by variation of size accuracy of the electrification roller and the spacer ring members, therefore the electrification potential of the photoconductor drum varies, thereby there is a problem that the toner is attached to a white background of the paper when forming the image and therefore a defective image occurs.

In order to resolve the problem in the proximity-electrifying system, there has been proposed an electrification member or roller including tape-like gap holding mechanisms each having a predetermined thickness (see, for reference, JP-A-2002-139893).

However, in the electrification roller including the tape-like gap holding mechanisms, when the electrification roller is used for a long time, because the tape-like gap holding mechanisms wear and the toner enters and fixes between the electrification roller and the gap holding mechanisms, there is a problem that the gap between the photoconductor drum and the electrification roller cannot be maintained.

In addition, in the electrification roller including the tape-like gap holding mechanisms, because the thickness of each of the gap holding mechanisms varies, there is a problem that a high accurate gap cannot be formed.

FIG. 15 illustrates a preceding electrification member proposed by the inventors in the present application.

The electrification member 210 includes a conductive supporting body 201 made of a metal, an electric resistance adjusting layer 202 formed on the conductive supporting body 201, and space holding members 203, 203 provided on opposite ends of the electric resistance adjusting layer 202, made of a resin and configured to maintain a gap between the electric resistance adjusting layer 202 and a member, for example, photoconductor drum facing the electric resistance adjusting layer 202. The space holding members 203, 203 are made of a thermal plastic resin which has a Durometer's hardness: a range of HDD30 to HDD70 or less and an abrasion mass measured by a tapered abrasion machine: 10 mg/1000 cycles or less (see Japanese Patent Laid-Open 2005-024830).

In the electrification member 210, each space holding member 203 is attached to the conductive supporting body 201 to contact with an end surface of the electric resistance adjusting layer 202.

In the electrification member 210, the space holding members 203 can be firmly fixed to the conductive supporting body 201 by applying an adhesive between the space holding members 203 and the conductive supporting body 201, whereby maintaining the stability of the gap.

However, because there is a great difference between linear coefficients of expansion of the space holding members 203 made of the resin and the conductive supporting body 201 made of the metal, there is a possibility that detachment at a boundary surface between the space holding member 203 and the conductive supporting body 201 occurs if the electrification roller is placed in low temperature or high temperature environment. Therefore, the electrification roller lacks in reliability throughout a long period. In addition, an adhesive strength at the boundary surface between the space holding members 203 and the conductive supporting body 201 is decreased by energization for a long time.

When the space holding members 203 are shifted, because the gap between the electric resistance adjusting layer 202 and the photoconductor drum varies, variation in electrification is easy to occur. In particular, a high accuracy for the gap can be accomplished by working the electric resistance adjusting layer 202 and the space holding members 203 simultaneously, but if the attachment for the space members 203 is insufficient, there is a problem that the space holding members 203 are rotated relative to the conductive supporting body 201 when a finishing process such as a grinding process, a cutting process for the electric resistance adjusting layer 202 and the space holding members 203 is carried out.

SUMMARY OF THE INVENTION

An object of the present invention is to provide a conductive member capable of maintaining a stable gap between the conductive member and a contacted member with the conductive member and having a high durability, a process cartridge having the conductive member and an image forming apparatus having the process cartridge.

To accomplish the above object, a conductive member according to one embodiment of the present invention includes a conductive supporting body, an electric resistance adjusting layer formed on the conductive supporting body, and space holding members provided on opposite ends of the electric resistance adjusting layer.

If the electric resistance adjusting layer is disposed to face a contacted member, the space holding members contact with the contacted member to form a gap between the electric resistance adjusting layer and the contacted member.

At least one engaging projection is provided on one of the electric resistance adjusting layer and each of the space holding members, and an engaging opening in which the engaging projection is inserted is provided in the other of the electric resistance adjusting layer and each of the space holding members.

DETAILED DESCRIPTION OF THE PREFERRED EMBODIMENTS

Preferred embodiments of the present invention will be explained in detail with reference to the accompanying drawings below.

Figure 1:
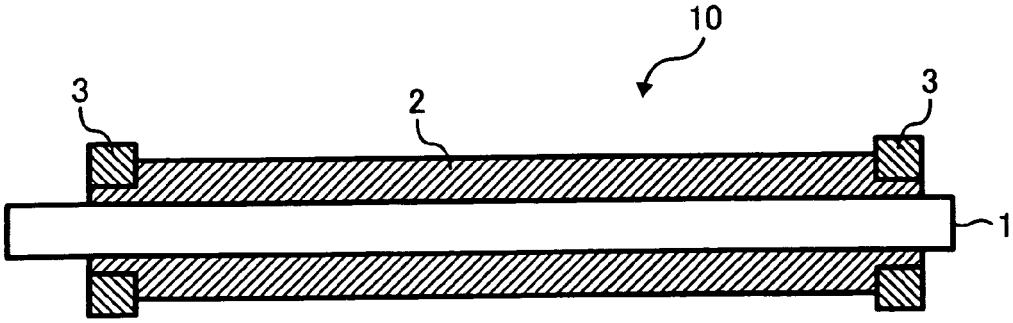
FIG. 1 is a sectional view showing a conductive member according to one embodiment of the present invention.
Figure 13:
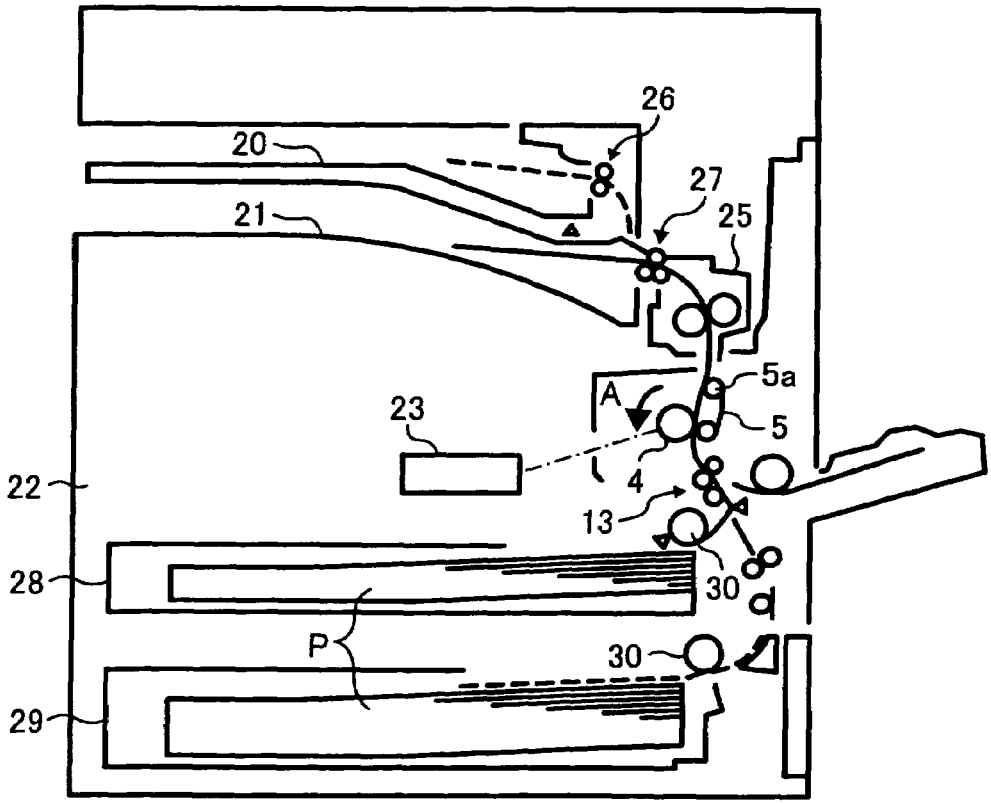
FIG. 13 is an explanatory view showing an image forming apparatus according to one embodiment of the present invention.

FIG. 1 illustrates one embodiment of a conductive member according to the present invention. The conductive member in this embodiment comprises, for example, a radiation type-electrification roller 10 used in a copying machine as shown in FIG. 13.

A transcription roller and so on used in the copying machine may be used as the conductive member instead of the electrification roller.

Figure 10:
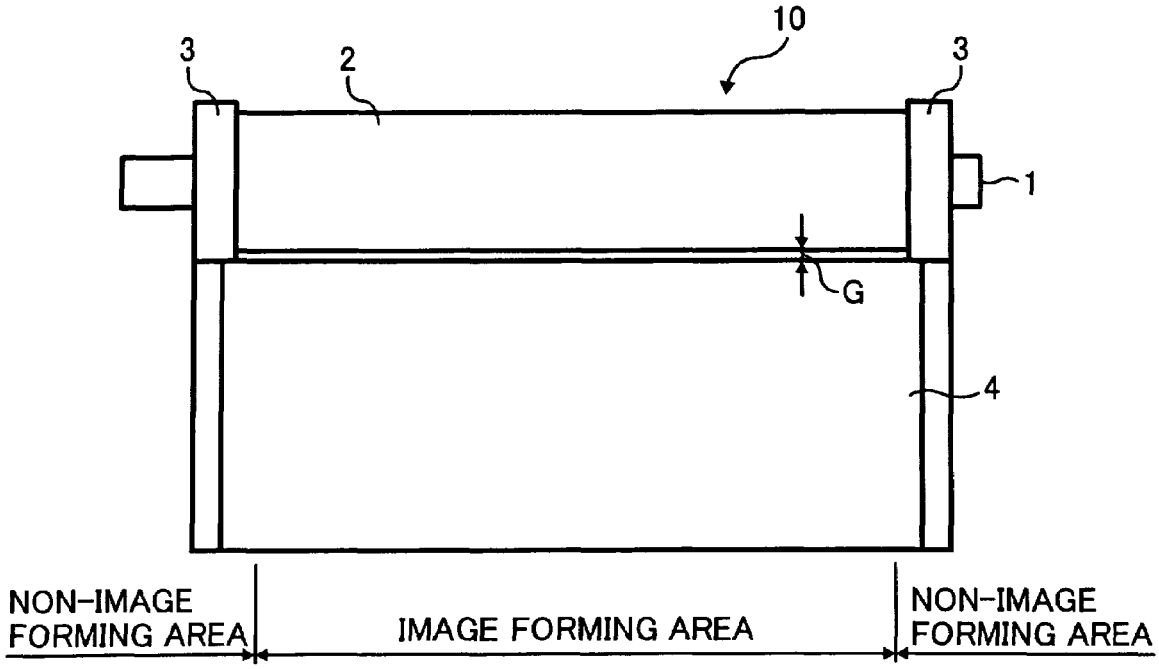
FIG. 10 is a schematic view showing a state in which the conductive member is mounted on an image carrier.
Figure 11:
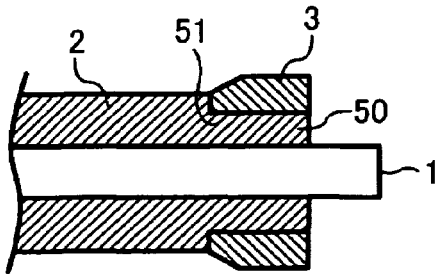
FIG. 11 is a partially enlarged sectional view of the conductive member obtained in each of the fifth to seventh examples.

The electrification roller 10 includes an elongate bar-like conductive supporting body 1, an electric resistance adjusting layer 2 formed on the conductive supporting body 1, and space holding members 3 and 3 provided on opposite ends of the electric resistance adjusting layer 2. If the electrification roller 10 is used to face a contacted member, for example, a photoconductor drum 4 (see FIG. 13) such as an image carrier or charged body, an outer peripheral surface of each of the space holding members 3 and 3 contacts with an outer surface of the photoconductor drum 4. An outer diameter of each of the space holding members 3 and 3 is set to be larger than that of the electric resistance adjusting layer 2 so as to form a gap G between the electric resistance adjusting layer 2 and the photoconductor drum 4 (FIGS. 1 and 10).

The electric resistance adjusting layer 2 and the space holding members 3 and 3 are made of a suitable material.

It is noted that in one embodiment at least one engaging projection is provided on one of the electric resistance adjusting layer 2 and each of the space holding members 3 and 3, and an engaging opening in which the engaging projection is inserted is provided in the other of the electric resistance adjusting layer 2 and each of the space holding members 3 and 3.

In one example, at least one engaging projection 50 is provided on each of the opposite ends of the electric resistance adjusting layer 2 and an engaging opening 51 in which the engaging projection 50 is inserted is provided in each of the space holding members 3 and 3 (see FIGS. 2, 3, 4 and 11).

Figure 2:
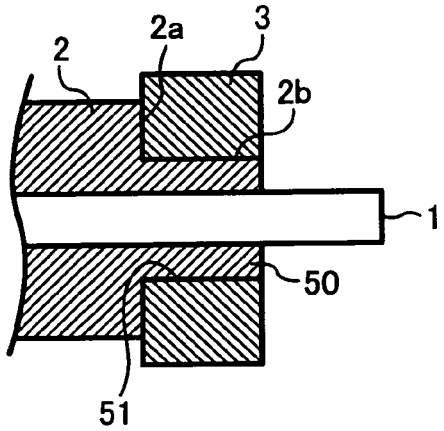
FIG. 2 is a partially enlarged sectional view of the conductive member shown in FIG. 1.
Figure 3:
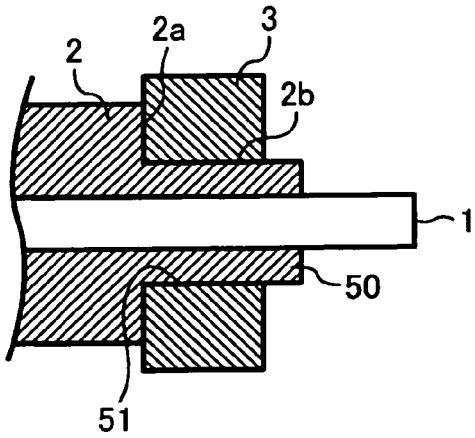
FIG. 3 is a partially enlarged sectional view showing a conductive member according to another embodiment of the present invention.
Figure 4:
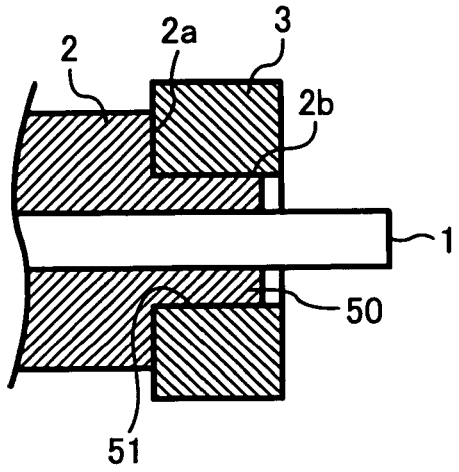
FIG. 4 is a partially enlarged sectional view showing a conductive member according to another embodiment of the present invention.

Meanwhile, when each engaging projection 50 is inserted in the opening 51, various forms may be taken so that an end of the engaging projection 50 is flush with an end surface of the space member 3, as shown in FIG. 2, the end of the engaging projection 50 is projected from the end surface of the space member 3, as shown in FIG. 3, and the end of the engaging projection 50 is disposed to be positioned inwardly of the space member 3 from the end surface of the space member 3, as shown in FIG. 4.

Figure 6:
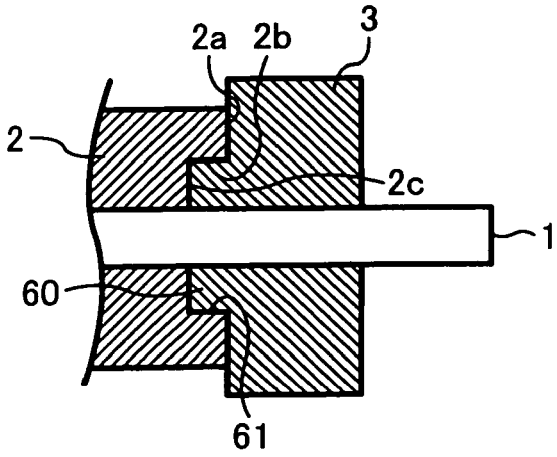
FIG. 6 is a partially enlarged sectional view showing a conductive member according to another embodiment of the present invention.

In another example, at least one engaging projection 60 is provided on each of the opposite ends of the space members 3 and 3 and an engaging opening 61 in which the engaging projection 60 is inserted is provided in the electric resistance adjusting layer 2 (see FIG. 6).

In another embodiment, a plurality of engaging projections having different outer diameters are provided on one of the electric resistance adjusting layer 2 and each of the space holding members 3 and 3, and a plurality of engaging openings in which the engaging projections are inserted are provided in the other of the electric resistance adjusting layer 2 and each of the space holding members 3 and 3.

Figure 5:
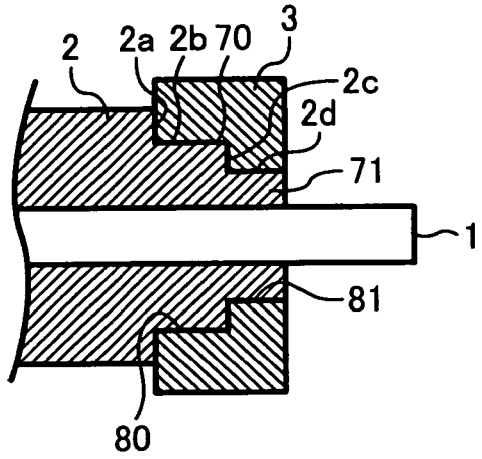
FIG. 5 is a partially enlarged sectional view showing a conductive member according to another embodiment of the present invention.

In one example, a first engaging projection 70 and a second engaging projection 71 having an outer diameter lesser than that of the first engaging projection 70 are provided on each of the opposite ends of the electric resistance adjusting layer 2, and a first and second engaging openings 80 and 81 in which the engaging projections 70 and 71 are inserted, respectively are provided in each of the space holding members 3 and 3, as shown in FIG. 5. In one embodiment, each of the engaging projections 50 and 60, the first and second engaging projections 70 and 71 has a circular shape in section, for example. Of course, these engaging projections may have other shapes.

As mentioned above, one or more engaging projections 50, 60, 70 and 71 are inserted in one or more engaging openings 51, 61, 80 and 81, respectively, therefore the electric resistance adjusting layer 2 and each of the space holding members 3 and 3 are surely joined. In addition, the electric resistance adjusting layer 2 and each of the space holding members 3 and 3 are surely joined throughout a long period by a good engagement of a resin of each of the space holding members 3 and 3 with a resin of the electric resistance adjusting layer 2.

Consequently, if the electrification roller is used for a long period, the gap G between the electrification roller 10 and the photoconductor drum 4 is stably maintained to enable to charge the surface of the photoconductor drum 4 uniformly and provide an electrification roller 10 having a high durability.

In addition, the number of the engaging projections is not limited to one or two, three or four engaging projections may be provided.

As mentioned above, when one or more engaging projections 50, 60, 70 or 71 are formed on the electric resistance adjusting layer 2 or each of the space holding members 3 and 3, one or more steps are formed at the both ends or an end of each of the space holding members 3 and 3.

In the electrification roller 10 shown in FIG. 1, the space holding member 3 and 3 are fixed into contact with two surfaces 2*a* and 2*b* forming the step of the electric resistance adjusting layer 2 (see FIGS. 2, 3 and 4).

As shown in FIG. 5, in the case of the two steps, the space holding members 3 and 3 are foxed into contact with four surfaces 2*a*, 2*b*, 2*c* and 2*d* forming the steps of the electric resistance adjusting layer 2.

Furthermore, in the electrification roller 10 as shown in FIG. 6, the space holding members 3 and 3 are fixed into contact with three surfaces 2*a*, 2*b* and 2*c* forming the step of the electric resistance adjusting layer 2.

In the illustrated embodiments, the photoconductor drum 4 has a cylindrical shape, and each of the space holding members 3, 3 has preferably a ring-like shape. In this way, when the space holding members 3 and 3 have the ring-like shapes, the electrification roller 10 can be rotated in response to the rotation of the photoconductor drum 4, whereby increasing the durability of the electrification roller 10 and the photoconductor drum 4.

The engaging projection or engaging projections provided on the each of the space holding members 3 and 3 or the electric resistance adjusting layer 2 are inserted in the corresponding engaging opening or engaging openings. In this way, when the engaging projection is inserted in the engaging opening, even if the step (s), the space holding members 3 and 3 or the electric resistance adjusting layer 2 has a low accuracy, the space holding members 3 and 3 can be surely fixed throughout a long period. In addition, if a finishing process is carried out on an assembly of the space holding members 3 and 3 and the electric resistance adjusting layer 2 (see FIG. 9), the space members 3 and 3 can be prevented from being rotated against a force applied to the space holding members 3 and 3 in the finishing process.

In one embodiment, the space holding members 3, 3 and the electric resistance adjusting layer 2 are fixed through an adhesive. In this way, if the space holding members 3, 3 and the electric resistance adjusting layer 2 are fixed through the adhesive, even if the step (s), or the space holding members 3 and 3 has a low accuracy, the space holding members 3 and 3 can be surely fixed throughout a long period and the space holding members 3 and 3 can be prevented from being rotated against a force applied to the space holding members 3 and 3 in the above-mentioned finishing process (see FIG. 9). In this case, because it is not desired that the adhesive is attached to the space holding members 3 and 3, the space holding members 3 and 3 are preferably made of polyethylene (PE), polyurethane and so on.

Figure 7:
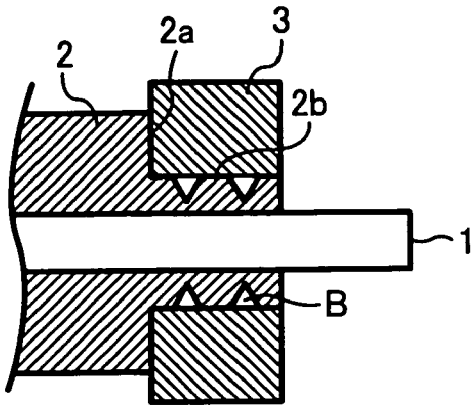
FIG. 7 is a partially enlarged sectional view showing a conductive member according to another embodiment of the present invention.
Figure 8:
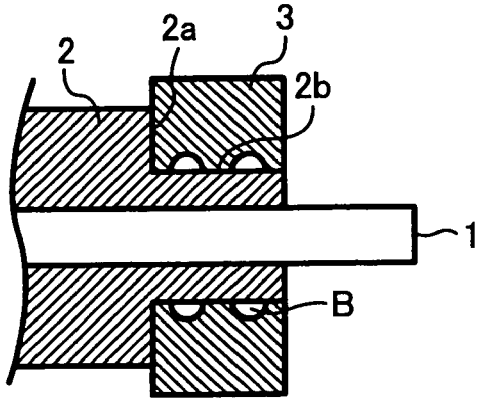
FIG. 8 is a partially enlarged sectional view showing a conductive member according to another embodiment of the present invention.
Figure 12:
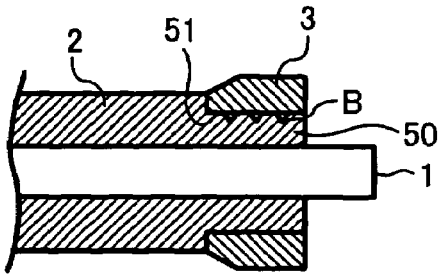
FIG. 12 is a partially enlarged sectional view of the conductive member obtained in the eighth example.

In one embodiment, for example, a plurality of adhesive reservoirs B are provided in the engaging projection 51 provided on the electric resistance adjusting layer 2, as shown in FIGS. 7, 8 and 12. In one example, each of the plurality of adhesive reservoirs B comprises a V-character shaped groove in section extending in a peripheral direction, as shown in FIGS. 7 and 12, in another example, each of the plurality of adhesive reservoirs B comprises a semi-circular shaped groove in section extending in the peripheral direction, as shown in FIG. 8. The shape and the number of each of the plurality of adhesive reservoirs B are not limited.

As shown in FIG. 10, in the conductive member or electrification roller 10 according to the present invention, a step between the outer peripheral surface of the electric resistance adjusting layer 2 and the outer peripheral surface of each of the space holding members 3 and 3 is provided in such a manner that the constant space G is formed between the outer peripheral surface of the electric resistance adjusting layer 2 and the outer peripheral surface of each of the space holding members 3 and 3, when the space holding members 3 and 3 contact with the photoconductor drum 4, as mentioned above.

Figure 9:
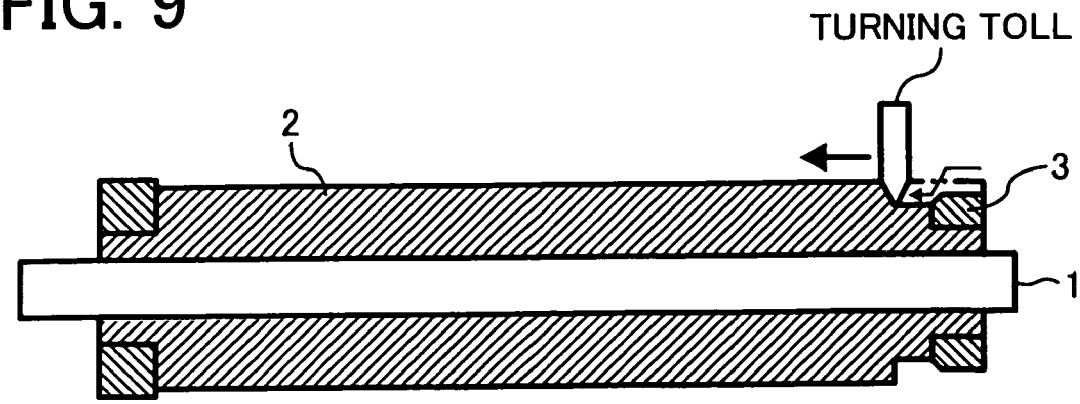
FIG. 9 is an explanatory view showing a process for forming the conductive member according to one embodiment of the present invention.

The step between the outer peripheral surface of the electric resistance adjusting layer 2 and the outer peripheral surface of each of the space holding members 3 and 3 is formed by the finishing process including the cutting and grinding processes carried out on the assembly of the electric resistance adjusting layer 2 mounted on the conductive supporting body 1 and the space holding members 3 and 3 mounted on the electric resistance adjusting layer 2, as shown in FIG. 9.

In this way, if the step between the electric resistance adjusting layer 2 and the space holding members 3 and 3 is formed by the finishing process carried out on the assembly of the conductive supporting body 1, the electric resistance adjusting layer 2 and the space holding members 3 and 3, it is possible to reduce variation of the gap G formed between the outer peripheral surface of the photoconductor drum 4 and the outer peripheral surface of the electric resistance adjusting layer 2, whereby increasing the accuracy of the gap G.

Because a characteristic necessary for the space holding members 3 and 3 is to maintain the gap between the space holding members 3, 3 and the photoconductor drum 4 for a long period, as a material for the space holding members 3 and 3 a material having a low hygroscopic property and a low abrasion resistance is preferable. Moreover, because the space holding members 3 and 3 contact with and slide on the photoconductor drum 4 to which toner or toner additive is difficult to be attached, it is also important that the photoconductor drum 4 is not worn.

The material for the space holding members 3 and 3 is suitably selected based on various conditions, but may include, for example, a resin such as polyethylene (PE), polypropylene (PP), polymethylmethacrylate (PMMA), polystyrene (PS), polystyrene copolymer (AS, ABS) or the like, or a resin such as polycarbonate (PC), polyurethane, fluorine resin or the like. The space holding members 3 and 3 are formed by forming such a resin.

As shown in FIG. 10, the conductive member 10 is disposed in contact with the photoconductor drum 4 with any pressure. The space holding members 3 and 3 are disposed on non-image forming areas of the photoconductor drum 4 out of an image forming area (see FIG. 10). In this state, if the electrification member is used as the electrification roller 10, it is possible to achieve the electrification of the photoconductor drum 4 by applying a voltage to the electrification roller 10.

If the electrification member is used as the transcription roller or toner carrier, the similar electrification can be applied to the transcription roller or toner carrier. In this case, it is desirable that a width of the electric resistance adjusting layer 2 is lesser than that of a photoconductive layer or image forming area of the photoconductor drum 4.

A shape of each of the conductive member 10 and the photoconductor drum 4 is not limited, and the photoconductor drum 4 may have any type such as a belt driving type or the like.

Also, the conductive member 10 may have various shapes such as a circular shape in section, an elliptic shape in section, a blade shape which is a flattered cylindrical shape and so on, but has preferably a cylindrical shape, similarly as the photoconductor drum 4.

When the conductive member 10 and the photoconductor drum 4 are disposed to face in the same plane constantly, a chemical degradation occurs on the surface of each of the conductive member 10 and the photoconductor drum 4 due to energization stress. However, when the conductive member 10 and the photoconductor drum 4 each of which has a cylindrical shape are rotated, it is possible to prevent continuous energization at the same place, therefore to reduce the chemical degradation generated on the surface of each of the conductive member 10 and the photoconductor drum 4 by the energization stress.

For example, as shown in FIG. 10, the rotation of the electrification member 10 may be set in either the same direction as or opposite direction to that of the photoconductor drum 4. A different peripheral velocity between the conductive member 10 and the photoconductor drum 4 may be set. For example, the peripheral velocity of the conductive member 10 may be set to be larger or lesser than that of the photoconductor drum 4.

In addition, it is possible to rotate intermittently the conductive member relative to the rotation of the photoconductor drum 4 in a range in which a function of the conductive member is not impaired. The gap G between the conductive member and the photoconductor drum 4 must be maintained to a predetermined value, preferably, 100 μm or less.

When the gap G is larger than the predetermined value, it is necessary to increasingly set a condition of applying a voltage to the conductive member 10. This is because electric degradation and abnormal discharge of the photoconductor member 4 are easy to occur.

As mentioned above, the space holding members 3 and 3 are formed to have the step between the electric resistance adjusting layer 2 and each space holding member (see FIG. 10). This step is formed by making the space holding members 3, 3 and the electric resistance adjusting layer 2 so that each space holding member 3 has a larger outer diameter than that of the electric resistance adjusting layer 2, as mentioned above.

More specifically, because it is preferable to maintain the gap G between the conductive member 10 and the photoconductor drum 4 to the predetermine value, if abutting surfaces of the photoconductor drum 4 with the space holding members 3 and 3 have the same level as the image forming area of the photoconductor drum 4, it is necessary that at least one portion of the outer diameter of each of the space holding members 3, 3 is larger than the outer diameter of the electric resistance adjusting layer 2. In one embodiment, it is preferable that the gap G be 100 μm.

In addition, the space holding members 3, 3 are contacted with the photoconductor drum 4 with a less contacting width by setting a portion of each of the space holding members adjacent the electric resistance adjusting layer 2 to the same level as or lower level than the electric resistance adjusting layer 2, thereby the high accurate gap G between the conductive member 10 and the photoconductor drum 4 can be maintained.

The space holding members 3 and 3 are made of an electric insulative resinous material, each of which has preferably a volume-resistivity value of $10^{13}\Omega$cm or more. In this way, if the space holding members 3 and 3 are made of an electric insulative resinous material, each of which has the volume resistivity value of $10^{13}\Omega$cm or more, the generation of an abnormal discharge (leak) current between each of the space holding members 3, 3 and a basic layer of the photoconductor drum 4 can be prevented.

If a volume resistivity value of the electric resistance adjusting layer 2 is preferably a range of $10^{6}\Omega$cm to $10^{9}\Omega$cm. If the volume resistivity value of the electric resistance adjusting layer 2 exceeds $10^{9}\Omega$cm, the electrification performance and the transcription performance become insufficient. If the volume resistivity value is lower than $10^{6}\Omega$cm, leakage is generated by voltage concentration to the entire photoconductor drum 4. However, if the volume resistivity value of the electric resistance adjusting layer 2 is within a range of $10^{6}$ to $10^{9}\Omega$cm, sufficient electrification performance and the transcription performance can be maintained and the generation of the abnormal discharge (leak) current due to the voltage concentration to the photoconductor drum 4 can be prevented, thereby a uniform image can be obtained.

A resin used for the electric resistance adjusting layer 2 is not specially limited, but may include a resin such as polyethylene (PE), polypropylene (PP), polymethylmethacrylate (PMMA), polystyrene (PS), and copolymer thereof (AS, ABS) or the like, or thermoplastic resin such as polycarbonate (PC), polyurethane, fluorine resin or the like. These resins are effective because they have good workability.

As high-molecular type ionic conductive material which is dispersed in the resins, high polymer compound containing polyetheresteramide component is preferable.

Because polyetheresteramide is ionic conductive high polymer material, it is uniformly dispersed and fixed at the molecular level in matrix polymer. Accordingly, there is no variation of an electric resistance value with dispersion defect as shown in a composite in which electronic conductive pigment such as metal oxide, carbon black or the like is dispersed.

In addition, because polyetheresteramide is high polymer material, it is hard to generate bleed-out. Regarding the blending quantity, it is necessary to have 30-70 wt. % of thermoplastic resin and 70-30 wt. % of high-molecular form ionic conductive material in order to set the electric resistance value to a desired value. A thickness of the electric resistance adjusting layer 2 made of the above-mentioned resin is preferably 100 μm or more and 500 μm or less. If the thickness of the electric resistance adjusting layer 2 is lesser than 100 μm, the thickness is too less and hence the abnormal discharge due to leak occurs, while if the thickness of the electric resistance adjusting layer 2 exceeds 500 μm, the thickness is too large and hence maintaining the accuracy of surface of the electric resistance adjusting layer 2 is difficult.

A semi-conductive resin composite formed from the above-mentioned resin can be easily manufactured by melting and kneading the mixture of each material with a kneading machine having two axes, a kneader or the like. A process for forming the electric resistance adjusting layer 2 on the circumference surface of the conductive supporting body 1 can be easily carried out by covering the conductive supporting body 1 with the above semi-conductive resin composite by using means such as extrusion molding and injection molding.

If the electrification member or roller 10 is constituted by forming only the electric resistance adjusting layer 2 on the conductive supporting body 1, the performance of the electrification roller 10 may be decreased by the fixation of toner to the electric resistance adjusting layer 2. In order to prevent such a defect, a surface layer (not shown) is formed on the outer surface of the electric resistance adjusting layer 2 for preventing the fixation of toner. The defect generated by the fixation of toner from the surface of photoconductor drum 4 to the surface of the electric resistance adjusting layer 2 can be prevented by forming the surface layer, and the product life of the electrification roller 10 can be improved.

The resistance value of the surface layer is set to be larger than the resistance value of the electric resistance adjusting layer 2. When the resistance value of the surface layer is set to be larger than the resistance value of the electric resistance adjusting layer 2, the voltage concentration and abnormal electric discharge (leakage) to a defective portion of the photoconductor drum 4 are avoidable by the difference of the resistance value.

However, if the resistance value of the surface layer is too high, electrification ability and transcription ability lack, so that it is preferable for the difference of the resistance value between the surface layer and the electric resistance adjusting layer 2 to be equal or lesser than $10^{3}\Omega$cm.

A material for forming the surface layer is preferably fluorine-system resin, silicone-system resin, polyamide resin, polyester resin or he like. Because these resinous materials are superior in non-adherence, they are effective to prevent the fixation of toner. Since each resin material has electrically insulative property, the resistance of surface layer can be adjusted by dispersing various conductive materials with respect to the resin material. A process for forming the surface layer on the electric resistance adjusting layer 2 is conducted in such a manner that coating material is made by dispersing the material for constituting the surface layer in organic solvent, and then the electric resistance adjusting layer 2 is coated by spray coating, dipping, roll coat or the like. It is preferable that the thickness of the surface layer be about 10 μm to 30 μm.

The resin for constituting the surface layer is usable either one fluid paint or tow fluid paints, while if two fluid paints using together a hardening agent are utilized, anti-environment and non-adherence can be increased. In the case of the two fluid paints, a method for bridging or cross linking and hardening the resin by heating a paint film is generally used.

However, if the electric resistance adjusting layer 2 is made of a thermoplastic resin, a high temperature heating cannot be used. As the two fluid paints, a base compound having hydroxyl in molecular and isocyanate-system resin generating cross-linking reaction with the hydroxyl are preferably used. If the isocyanate-system resin is used, the cross-linking and hardening reactions occur at a relatively low temperature, for example, 100° C. or less.

The inventors of the present invention have confirmed that a silicon-system resin has a high non-adherence to the toner as result of review of the non-adherence of toner, in particular, and have found that acrylic silicon resin having an acrylic bone structure in molecular is effective.

Because an electric characteristic, in particular, an electric resistance value is important for the conductive member 10, it is necessary to use a conductive surface layer. The conductive surface layer is formed by dispersing a conductive material in the resin constituting the surface layer. Although the conductive material is not limited in particular, there may be used any of a conductive carbon such as Ketjen black EC, acetylene black or the like, a carbon for a rubber such as SAF, ISAF, HAF, FEF, GPF, SRF, FT, MT or the like, a carbon for color with oxidation treatment or the like, pyrolysis carbon, a metal such as indium doping tin oxide (ITO), tin oxide, titanium oxide, zinc oxide, copper, silver, germanium, metal oxide or the like, and a conductive polymer such as polyaniline, polypyrrole, polyacetylene or the like.

Moreover, as a conductive-giving material, there may be used any of an ionic conductive material, inorganic ionic conductive material such as sodium perchlorate, lithium perchlorate, calcium perchlorate, lithium chloride or the like, and an organic ionic conductive material such as degenerative aliphatic acid dimethyl ammonium ethosulfate, stearic acid ammonium acetate, lauryl ammonium acetate or the like.

The conductive member 10 according to the present invention is produced through injection molding the resin constituting the electric resistance adjusting layer 2 on the conductive supporting body 1 to form the electric resistance adjusting layer 2 having at the opposite ends the engaging projections, thereafter, applying the adhesive on the engaging projections at the opposite ends of the electric resistance adjusting layer 2, and inserting the engaging projections into the openings of the space holding members 3 and 3 to fix the space holding members to the electric resistance adjusting layer 2 adhesively.

As shown in FIG. 9, in order to accomplish less variation in the step between the space holding members 3, 3 and the electric resistance adjusting layer 2, in a state in which the space holding members 3, 3 and the electric resistance adjusting layer 2 are integrally formed, the outer peripheries thereof are finished through cutting and grinding processes and so on. Next, the surface layer is formed on the electric resistance adjusting layer 2 with protecting the space holding members 3, 3 to complete the electric resistance adjusting layer 2.

The conductive member or electrification roller 10 causes the surface of the photoconductor drum 4 to charge into non-contact state with the photoconductor drum 4. Therefore, photoconductor drum 4 and the electrification roller 10 are prevented from becoming dirty. In addition, the electrification roller 10 can be made of a rigid material, accordingly, it is possible to form an electrification roller having a high accuracy, whereby preventing the variation in electrification.

Figure 14:
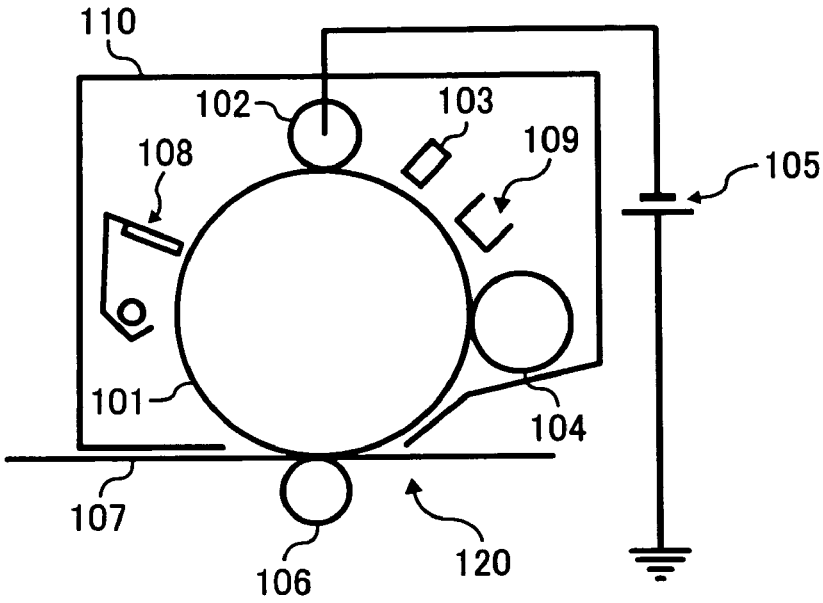
FIG. 14 is an explanatory view of an image forming apparatus using a conventional electrification roller.

The conductive member 10 may be structured from a removable process cartridge 110 provided to be disposed close to a charged member, for example, the photoconductor drum 4 (see FIG. 14).

In this way, if the conductive member 10 is structured from the process cartridge 110 disposed close to the charged member, a stable image quality can be obtained throughout a long period, and user maintenance is possible, thereby the exchange of the process cartridge is simplified.

Moreover, an image forming apparatus including the process cartridge 110 (see FIG. 14) is provided. The image forming apparatus including the process cartridge 110 has a high reliability and a good image quality.

As shown in FIG. 13, the image forming apparatus according the present invention includes a main body, a paper feeding part 22 provided in a lower portion within the main body, an image forming part having the photoconductor drum 4 disposed above the paper feeding part 22 and a pair of paper ejecting rollers 26 and 27 disposed above the image forming part.

An image is formed on a transfer paper P fed from the paper feeding part 22 by the image forming part. The transfer paper P is ejected to a bottle tray 20 or ejection tray 21 by the paper ejecting rollers 26 and 27. The paper feeding part 22 is provided with two-stepped trays 28 and 29 disposed up and down, on each of which a paper feeding roller 30 is disposed.

Meanwhile, reference number 23 shows a writing unit which illustrates light on the uniformly charged surface of the photoconductor drum 4 and writes an image on the uniformly charged surface. In addition, a pair of resist rollers 13 to compensate a skew of the transfer paper and synchronize the image on the photoconductor drum 4 with the feeding of the transfer paper is provided in an upstream position in a feeding direction of the transfer paper relative to the photoconductor drum 4.

Furthermore, a fixing unit 25 is provided in a downstream position in the feeding direction of the transfer paper relative to the photoconductor drum 4. The photoconductor drum 4 is provided rotatably in a direction of arrow A in the image forming part, as shown in FIG. 13.

Disposed in a periphery of the photoconductor drum 4 are the electrification roller 102 (see FIG. 14), the development roller 104 (see FIG. 14) to form a toner image exposing the electrostatic latent image on the photoconductor drum written by the writing unit 23 on the surface of the photoconductor drum 4 charged by the electrification roller 102, a transfer and feeding belt 5 to transfer the toner image to the transfer paper P, the cleaning device 108 (see FIG. 14) to remove residual toner on the photoconductor drum 4 after transferring the toner image, and a neutralization lamp (not shown) to remove unnecessary charge on the photoconductor drum 4.

In the image forming apparatus, when image forming operation is initiated, the photoconductor drum 4 rotates in the direction of arrow A, the electricity on the surface of the photoconductor drum 4 is removed by the neutralization lamp and standardized to a reference potential. Next, the surface of the photoconductor drum 4 is charged uniformly by the electrification roller 102, the charged surface is subjected to illumination of light depending on image information from the writing unit 23, therefore the electrostatic latent image is formed on the charged surface. Subsequently, when the photoconductor drum 4 is rotated in the direction of arrow A and moved to a position of the development roller 104 (see FIG. 14), thereat, the toner is attached to the photoconductor drum by a development sleeve (not shown), and the electrostatic latent image is formed into the toner image (exposed image).

On the other hand, the transfer paper P is fed from any of the trays 28 and 29 of the paper feeding part 22 by the paper feeding roller 30, as shown in FIG. 13, the transfer paper is stopped once by the pair of resist rollers 13, then is conveyed with a right timing coinciding with a leading end of the transfer paper P with a leading end of the image on the photoconductor drum 4, and the toner image on the photoconductor drum 4 is transferred to the transfer paper P by the transfer and feeding belt 5.

The transfer paper P is conveyed by the transfer and feeding belt 5 and separated from the transfer and feeding belt 5 at a portion of a drive roller 5*a* for a curvature separation due to rigidity of the transfer paper itself to be directed to the fixing unit 25. At the fixing unit 25, a heat and a pressure are added to the transfer paper P and hence the toner is fixed to the transfer paper P. The transfer paper is then ejected to a designated ejected place, that is to say, either the ejection tray 21 or bottle tray 20. Thereafter, the photoconductor drum is rotated to a position corresponding to the cleaning device 108 which is the next process and the residual toner on the photoconductor drum 4 is removed by a cleaning blade of the cleaning device, and the process is shifted to the next step.

In the above-mentioned embodiments, although the conductive member 10 according to the present invention is embodied to the electrification roller, the conductive member may be embodied to electrification members other than the electrification roller, for example, a blade or the like. In addition, as the conductive member 10, a toner carrier, transfer member, transfer roller or the like may be used.

Next, experimental examples and comparative examples with respect to some conductive members having various structures and different materials and so on are explained.

FIRST EXAMPLE

The electric resistance adjusting layer 2 having at the opposite ends the steps, or engaging projections 50 as shown in FIGS. 1 and 2 was formed by covering a core shaft or the conductive supporting body 1 having the external diameter of 8 mm and made of stainless-steel with a resinous composition including 50 wt. % of ABS resin (DENKA ABS GR-0500, DENKI KAGAKU KOGYO) and 50 wt. % of polyetheresteramide (IRGASTAT P18, CHIBA Specialty Chemicals) through an injection molding. Next, the ring shaped space holding members 3, 3 each having the engaging opening 51 and comprising high-density polyethylene resin (Novatech PP HY540, Japan Polychem Corp.) were fixed to the opposite ends of the electric resistance adjusting layer 2 by inserting the engaging projections 50 in the engaging openings 51 and bonding the space holding members 3, 3 to the electric resistance adjusting layer 2. Thereafter, the outer diameter (the maximum outer diameter) of each of the space holding members 3, 3 was cut or ground to be 12.12 mm and the outer diameter of the electric resistance adjusting layer 2 was cut or ground and set to be 12.00 mm. Finally, the conductive member 10 was produced by forming a surface layer having a film thickness of about 10 μm comprising a resinous composition including acrylic silicon resin (3000VH-P Kawakami Paint), an isocyanate based hardening agent, and carbon black (35 wt. % with respect to the whole solid content), on the surface of the electric resistance adjusting layer 2 (see FIG. 1).

SECOND EXAMPLE

The electric resistance adjusting layer 2 having at central portions of the opposite ends thereof the steps, or engaging openings 61 as shown in FIG. 6 was formed by covering a core shaft or conductive supporting body 1 having the external diameter of 8 mm, made of stainless-steel with the resin composition prepared in the above-mentioned first example through an injection molding. Next, the ring shaped space holding members 3, 3 each having the engaging projection 60 (see FIG. 6) and comprising high-density polyethylene resin (Novatech PP HY540, Japan Polychem Corp.) were fixed to the opposite ends of the electric resistance adjusting layer 2 by inserting the engaging projections 60 in the engaging openings 61 and bonding the space holding members 3, 3 to the electric resistance adjusting layer 2, Thereafter, the outer diameter (the most outer diameter) of each of the space holding members 3, 3 was cut or ground to be 12.12 mm and the outer diameter of the electric resistance adjusting layer 2 was cut or ground to be 12.00 mm. Finally, the conductive member was produced by forming a surface layer having a film thickness of about 10 μm comprising a resinous composition (volume resistivity value: $8.3\times10^{9}\Omega$cm) including a silicon-system resin (slip coating agent HS-3, Toshiba Silicon Co.,), a hardening agent (XC9603, Toshiba Silicon Co.,), a catalyst (YC6831, Toshiba Silicon Co.,), and carbon black (30 wt. % with respect to the whole solid content), on the surface of the electric resistance adjusting layer 2 (see FIG. 6).

THIRD EXAMPLE

The conductive member was produced by the same structure as in the first example, excepting two circumferentially formed V-shaped adhesive reservoirs B each having a width of about 2 mm and a depth of about 2 mm, and provided on the surface 2*b* constituting each step, as shown in FIG. 7.

FOURTH EXAMPLE

The electric resistance adjusting layer 2 having at each of the opposite ends the two steps, or engaging projections 70 and 71 as shown in FIG. 5 was formed by covering a core shaft or conductive supporting body 1 having the external diameter of 8 mm and made of stainless-steel with a resinous composition (volume resistivity value: $6.3\times10^{8}\Omega$cm) including 40 wt. % of ABS resin (DENKA ABS GR-0500, DENKI KAGAKU KOGYO) and 60 wt. % of polyetheresteramide (IRGASTAT P18 CHIBA Specialty Chemicals) by an injection molding. Next, the ring shaped space holding members 3, 3 each having the engaging openings 80 and 81 comprising high-density polyethylene resin (Novatech PP HY540, Japan Polychem Corp.) were fixed to the opposite ends of the electric resistance adjusting layer 2 by inserting the engaging projections 70 and 71 in the engaging openings 80 and 81 and bonding the space holding members 3, 3 to the electric resistance adjusting layer 2. Thereafter, the outer diameter (the maximum outer diameter) of each of the space holding members 3, 3 was cut or ground to be 12.12 mm and the outer diameter of the electric resistance adjusting layer 2 was cut or ground and set to be 12.00 mm. Finally, the conductive member 10 was produced by forming a surface layer of about 10 μm film thickness comprising a resinous composition (volume resistivity value: $2.0\times10^{9}$ Ωcm) including acrylic silicon resin (3000VH-P Kawakami Paint), an isocyanate based hardening agent, and carbon black (35 wt. % with respect to the whole solid content) on the surface of the electric resistance adjusting layer 2 (see FIG. 5).

FIRST COMPARATIVE EXAMPLE

Figure 15:
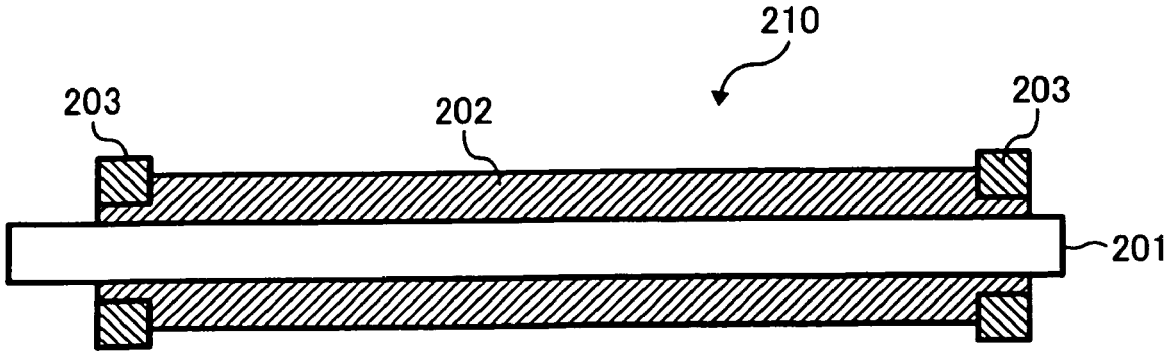
FIG. 15 is sectional view showing an electrification member proposed by the inventors of the present applications.

The electric resistance adjusting layer 2 having the external diameter of 12.00 mm was formed by covering a core shaft or conductive supporting body 1 having the external diameter of 8 mm and made of stainless-steel with a resinous composition (volume resistivity value: $2.1\times10^{8}$Ωcm) including 50 wt. % of ABS resin (Denka ABS GR-0500, Denki Kagaku Kogyo) and 50 wt. % of polyetheresteramide (IRGASTAT P18 Chiba Specialty Chemicals) through an injection molding. A surface layer having about 10 μm film thickness comprising a resinous composition including urethane resin (Adeka bontire AM36, Asasi Denka), an isocyanate based hardening agent, and carbon black (30 wt. % with respect to the whole solid content) was formed on the surface of the electric resistance adjusting layer 2. Finally, ring-shaped space holding members made of polyamizo resin (Novamid1010C2, Mitsubishi Engineering Plastic) were disposed and bonded on the conductive supporting body at the opposite ends of the electric resistance adjusting layer, and then the outer diameter of each of the space holding members was cut or ground to be 12.10 mm and the outer diameter of the electric resistance adjusting layer was cut or ground and set to be 12.00 mm, thereby the conductive member was produced (see FIG. 15).

SECOND COMPARATIVE EXAMPLE

The electric resistance adjusting layer was formed by covering a core shaft or the conductive supporting body 1 having the external diameter of 8 mm and made of stainless-steel with a rubber composition including 100 wt. % of epichlorohydrin-rubber (Epichlomer CG, Daiso Co., Ltd) and 3 wt. % of polyetheresteramide (IRGASTAT P18 Chiba Specialty Chemicals) by an extrusion molding and forming a rubber covering layer, thereafter, by adding a vulcanization process to the rubber covering layer, then grinding the rubber covering layer to which the vulcanization process is achieved to be finished to the exterior diameter of 12 mm. Next, a surface layer of about 10 μm film thickness comprising a resinous composition including polyvinylbutyral resin (Denka Butyral 3000-K Denki Kagaku Kogyo), an isocyanate based hardening agent, and tin oxide (25 wt. % with respect to the whole solid content) was formed on the surface of the electric resistance adjusting layer. Finally, the conductive member was produced by attaching tape-like members (Daituck PF025-H, Dainippon Ink Co., Ltd) made of polyethylene terephthalate resin (PET) and having a thickness of 50 μm to peripheries of opposite ends of the electric resistance adjusting layer.

THIRD COMPARATIVE EXAMPLE

The electric resistance adjusting layer was formed by covering a core shaft or the conductive supporting body having the external diameter of 8 mm and made of stainless-steel with a resinous composition comprising 80 wt. % of ABS resin (Denka ABS GR-0500, Denki Kagaku Kogyo) and 20 wt. % of ionic conductive high molecular composition (Leorex AS-1720, Daiich Kogyo Seiyaku) including quaternary ammonium base by injection molding. Next, ring-shaped space holding members made of polyamide resin (Novamid 1010C2, Mitsubishi Engineering Plastic Co., Ltd) were disposed and bonded on the opposite ends of the electric resistance adjusting layer, thereafter, the outer diameter of each of the space holding members 3, 3 was cut to be 12.12 mm and the outer diameter of the electric resistance adjusting layer 2 was cut to be 12.00 mm (see FIG. 15). Next, the conductive member 10 was produced by forming a surface layer of about 10 μm film thickness comprising a resinous composition including fluorine resin (Lumi FronLF-600, Asahi Glass Co., Ltd), an isocyanate based hardening agent, and tin oxide (45 wt. % with respect to the whole solid content) on the surface of the electric resistance adjusting layer and attaching heat shrinkability PFA tubes having a thickness of 50 μm to the opposite ends of the electric resistance adjusting layer.

FOURTH COMPARATIVE EXAMPLE

The conductive member was produced by the same structure as in the first comparative example, excepting that the ring-like space holding members (exterior diameter: 12.12 mm) made of stainless steel were attached to the opposite ends of the electric resistance adjusting layer.

The conductive member obtained in each of the first to fourth examples and the comparative examples was formed into the electrification roller, mounted on the image forming apparatus (see FIG. 14). The amount of gap between the electrification roller and the photoconductor drum was measured. Then, the applied voltages were set to DC=−800V, AC=2400 Vpp (frequency=2K Hz) and 600,000 papers (A4) was used for outputting images. The charge variations (evaluation of gap variations between the electrification roller and the photoconductor drum through the images), a state of the space holding members, a rotational torque of the space holding members, and the images were evaluated. The evaluation environment was in 23° C. and 60% RH.

The evaluation results are shown in the following table 1.

TABLE 1

| | Electric resistance adjusting layer (Ω cm) | Surface layer (Ω cm) | Variation in electrification | State of space holding members | Rotational torque of space holding members (kgf) |
|---|---|---|---|---|---|
| First Example | $2.1\times10^{8}$ | $2.0\times10^{10}$ | No | Good | 3.5 |
| Second Example | $2.1\times10^{8}$ | $8.3\times10^{10}$ | No | Good | 4.7 |
| Third Example | $2.1\times10^{8}$ | $2.0\times10^{10}$ | No | Good | 5.0 |
| Fourth Example | $9.4\times10^{8}$ | $2.0\times10^{10}$ | No | Good | 4.5 |
| First comparative Example | $5.7\times10^{8}$ | $7.2\times10^{11}$ | Occurrence | Occurrence of gap between space holding members and | 1.8 |

TABLE 1-continued

| | Electric resistance adjusting layer (Ω cm) | Surface layer (Ω cm) | Variation in electrification | State of space holding members | Rotational torque of space holding members (kgf) |
|---|---|---|---|---|---|
| | | | | electric resistance adjusting layer | |
| Second comparative example | $4.0 \times 10^8$ | $6.6 \times 10^{11}$ | Occurrence | Occurrence of removal of tape members | Impossible torque measurement for tape members |
| Third comparative example | $7.2 \times 10^{11}$ | $3.5 \times 10^7$ | Occurrence of local leak | Occurrence of floating of PFA tubes | Impossible torque measurement for tape members |
| Fourth Comparative example | $3.5 \times 10^8$ | $7.2 \times 10^{11}$ | Impossible evaluation for leak from space holding members | — | — |

In the table 1,

1) The resistances of the electric resistance adjusting layer and the surface layer are values before the evaluation, 2) The variations in charge, the state of the space holding members, the rotational torque of the space holding members are evaluated after the output of the images on 600,000 papers, and 3) It is evaluated that 2 kgf or more of the rotational torque of the space holding members is good.

FIFTH EXAMPLE

The electric resistance adjusting layer having the exterior diameter of 14 mm and engaging projections the exterior diameter of each of which is 11.1 mm was formed by covering a core shaft or the conductive supporting body having the external diameter of 8 mm and made of stainless-steel with a resinous composition (volume resistivity value: $2.1\times10^8$ Ωcm) including 50 wt. % of ABS resin (Denka ABS GR-0500, Denki Kagaku Kogyo) and 50 wt. % of polyether-esteramide (IRGASTAT P18 Chiba Specialty Chemicals) by injection molding. Next, ring shaped space holding members comprising high-density polyethylene resin (Novatech PP HY540, Japan Polychem Corp.) were fixed to the steps at the opposite ends of the electric resistance adjusting layer. Thereafter, the outer diameter (the maximum outer diameter) of each of the space holding members was cut or ground to be 12.10 mm and the outer diameter of the electric resistance adjusting layer was cut or ground and set to be 12.00 mm (see FIG. 11). The thickness of each of the space holding members was 0.4 mm. Next, the conductive member was produced by forming a surface layer of about 10 μm film thickness comprising a resinous composition (surface resistivity value: $2.1\times10^{10}$Ωcm) including acrylic silicon resin (3000VH-P Kawakami Paint), an isocyanate based hardening agent, and carbon black (30 wt. % with respect to the whole solid content) on the surface of the electric resistance adjusting layer through spray coating.

SIXTH EXAMPLE

The electric resistance adjusting layer having the exterior diameter of 14 mm and engaging projections, the exterior diameter of each of which is 11.3 mm was formed by covering a core shaft or the conductive supporting body 1 having the external diameter of 8 mm and made of stainless-steel with a resinous composition obtained in the fifth example by injection molding. Next, ring shaped space holding members comprising high-density polyethylene resin (Novatech PP HY540, Japan Polychem Corp.) were fixed and bonded to the steps at the opposite ends of the electric resistance adjusting layer. Thereafter, the outer diameter (the maximum outer diameter) of each of the space holding members was cut or ground to be 12.10 mm and the outer diameter of the electric resistance adjusting layer was cut or ground and set to be 12.00 mm (see FIG. 11). The thickness of each of the space holding members was 0.5 mm. Next, the conductive member 10 was produced by forming a surface layer of about 10 μm film thickness comprising a resinous composition (surface resistivity value: $2.1\times10^{10}$Ωcm) including acrylic silicon resin (3000VH-P Kawakami Paint), an isocyanate based hardening agent, and carbon black (30 wt. % with respect to the whole solid content) on the surface of the electric resistance adjusting layer through spray coating.

SEVENTH EXAMPLE

The electric resistance adjusting layer having the exterior diameter of 14 mm and engaging projections, the exterior diameter of each of which is 10.9 mm was formed by covering a core shaft or the conductive supporting body having the external diameter of 8 mm and made of stainless-steel with a resinous composition obtained in the fifth example by injection molding. Next, ring shaped space holding members comprising high-density polyethylene resin (Novatech PP HY540, Japan Polychem Corp.) were fixed and bonded to the steps at the opposite ends of the electric resistance adjusting layer. Thereafter, the outer diameter (the maximum outer diameter) of each of the space holding members was cut or ground to be 12.10 mm and the outer diameter of the electric resistance adjusting layer was cut or ground and set to be 12.00 mm (see FIG. 11). The thickness of each of the space holding members was 0.6 mm. Next, the conductive member 10 was produced by forming a surface layer of about 10 μm film thickness comprising a resinous composition (surface resistivity value: $2.1\times10^{10}$Ωcm) including acrylic silicon resin (3000VH-P Kawakami Paint), an isocyanate based hardening agent, and carbon black (30 wt. % with respect to the whole solid content) on the surface of the electric resistance adjusting layer through spray coating.

EIGHTH EXAMPLE

The conductive member was produced by the same structure as in the first example, excepting three circumferentially formed adhesive reservoirs B each having a width of about 1 mm and a depth of about 1 mm, and provided on the surface constituting each step as shown in FIG. 8.

FIFTH COMPARATIVE EXAMPLE

A rubber covering layer was formed by covering a core shaft or the conductive supporting body 1 having the external diameter of 8 mm and made of stainless-steel with a rubber composition (volume resistivity value: $4.0\times10^{10}\Omega$cm) including 100 wt. % of epichlorohydrin-rubber (Epichlomer CG, Daiso Co., Ltd) and 3 wt. % of ammonium perchlorate by an extrusion molding. Thereafter, by adding a vulcanization process to the rubber covering layer, and then grinding the rubber covering layer to which the vulcanization process is achieved to be finished to the exterior diameter of 12 mm, the electric resistance adjusting layer was formed. Next, a surface layer of about 10 μm film thickness comprising a resinous composition (surface resistivity value: $2.0\times10^{10}\Omega$cm) including polyvinylbutyral resin (Denka Butyral 3000-K Denki Kagaku Kogyo), an isocyanate based hardening agent, and tin oxide (60 wt. % with respect to the whole solid content) was formed on the surface of the electric resistance adjusting layer. Finally, the conductive member was produced by attaching ring-like space holding members (exterior diameter: 12.1 mm) made of polyamide resin (Novamid 1010C2, Mitsubishi Engineering Plastic Co., Ltd) to the opposite ends of the electric resistance adjusting layer.

SIXTH COMPARATIVE EXAMPLE

The conductive member was produced by the same structure as in the fifth comparative example, excepting that tape-like members having a width of about 8 mm and a thickness of about 60 μm as the space holding members were attached to the opposite ends of the electric resistance adjusting layer.

SEVENTH COMPARATIVE EXAMPLE

The electric resistance adjusting layer was formed by covering a core shaft or the conductive supporting body having the external diameter of 8 mm and made of stainless-steel with a resinous composition (volume resistivity value: $2.0\times10^{8}\Omega$cm) including 50 wt. % of ABS resin (Denka ABS GR-0500, Denki Kagaku Kogyo) and 50 wt. % of polyether-esteramide (IRGASTAT P18 Chiba Specialty Chemicals) by injection molding. Next, ring shaped space holding members comprising high-density polyethylene resin (Novatech PP HY540, Japan Polychem Corp.) were disposed and bonded to the opposite ends of the electric resistance adjusting layer. Thereafter, the outer diameter (the maximum outer diameter) of each of the space holding members 3, 3 was cut or ground to be 12.10 mm and the outer diameter of the electric resistance adjusting layer was cut or ground and set to be 12.00 mm. Next, the conductive member was produced by forming a surface layer of about 10 μm film thickness comprising a resinous composition (surface resistivity value: $2.0\times10^{10}\Omega$cm) including acrylic silicon resin (3000VH-P Kawakami Paint), an isocyanate based hardening agent, and carbon black (30 wt. % with respect to the whole solid content) on the surface of the electric resistance adjusting layer through spray coating.

The conductive member obtained in each of the fifth to eighth examples and the fifth to seventh comparative examples was mounted on the image forming apparatus as shown in FIG. 14 as the electrification roller, and the gap between the electrification roller and the photoconductor drum was measured under a room environment (23° C. and 60% RH). The image forming apparatus was placed for 24 hours under each environment of LL; 10° C., 65% RH, HH; 30° C., 90% RH. Space variations in the gap between the electrification roller and the photoconductor drum under each environment were computed. Subsequently, voltages applied to the image forming apparatus were set to DC=−800V, AC=2400 Vpp (frequency=2K Hz) and 300,000 papers (A4) was used for outputting images, and the evaluation about the gap amount between the electrification roller and the photoconductor drum, the state of the surface of the electrification roller, the images were evaluated. In the evaluation of the state of the surface of the electrification roller and the images, it was good if there was no problem on practice. Each environment of 23° C., 60% RH, LL; 10° C., 65% RH, HH; 30%, 90% was changed every 10,000 papers.

The evaluation results are shown in the following table 2.

TABLE 2

| | Gap amount between electrification member and image carrier (mm) | Environment variation amount in gap (mm) | Gap amount between electrification member and image carrier after passing 300,000 papers (mm) | Adhesion of toner to rollers after passing 300,000 papers | Images after passing 300,000 papers |
|---|---|---|---|---|---|
| First Example | 0.05 ± 0.012 | 0.006 | 0.05 ± 0.013 | Good | Good |
| Second Example | 0.05 ± 0.010 | 0.008 | 0.05 ± 0.011 | Good | Good |
| Third Example | 0.05 ± 0.010 | 0.010 | 0.05 + 0.011 | Good | Good |
| Fourth Example | 0.05 ± 0.012 | 0.015 | 0.05 ± 0.013 | Good | Good |
| First comparative Example | 0.05 ± 0.030 | 0.023 | 0.04 ± 0.050 | Occurrence | Occurrence of image variation |
| Second comparative example | 0.03 ± 0.020 | 0.025 | 0.03 ± 0.040 | Occurrence | Occurrence of image variation |
| Third comparative example | 0.05 ± 0.012 | 0.030 | 0.05 ± 0.015 | Occurrence | Occurrence of image variation |

As is apparent from table 2, the electrification rollers formed in the fifth to eighth examples have small variations in the gap under each environment.

According to the conductive member of the present invention, because the electric resistance adjusting layer 2 or the space holding members 3, 3 have one or more engaging projections or engaging openings, and the electric resistance adjusting layer and the space holding members are fixed by two surfaces or more constituting the step or steps formed by the engaging projection or projections, the efficient engagement between the resins of the electric resistance adjusting layer 2 and the space holding members 3, 3 can be accomplished, thereby the space holding members 3, 3 can be fixed to the electric resistance adjusting layer 2 throughout a long period. Therefore, a stable gap is maintained between the photoconductor drum 4 and the conductive member, the surface of the photoconductor drum can be charged uniformly, and the durability of the conductive member can be increased.

Although the preferred embodiments of the present invention have been mentioned, the present invention is not limited to these embodiments, various modifications and changes can be made to the embodiments.

What is claimed is:

1. A conductive member, comprising:

a conductive supporting body;

an electric resistance adjusting layer formed on the conductive supporting body;

space holding members provided on opposite ends of the electric resistance adjusting layer, the space holding members being configured to be in contact with a contacted member to form a gap between the electric resistance adjusting layer and the contacted member;

a plurality of engaging openings having different diameters and provided in one of the electric resistance adjusting layer and each of the space holding members, the plurality of engaging openings including first and second engaging openings provided in the one of the electric resistance adjusting layer and each of the space holding members; and a plurality of engaging projections having different diameters and provided on an other of the electric resistance adjusting layer and each of the space holding members to be inserted in the engaging openings, respectively, the plurality of engaging projections including first and second engaging projections provided on the other of the electric resistance adjusting layer and each of the space holding members to be inserted in the engaging openings, respectively, wherein the first engaging projection has an external diameter smaller than an external diameter of the electric resistance adjusting layer and smaller than an external diameter of each of the space holding members, and wherein the second engaging projection has an external diameter smaller than the external diameter of the first engaging projection.

2. The conductive member according to claim 1, wherein the first engaging projection is provided to extend from each of the opposite ends of the electric resistance adjusting layer along an axial direction of the electric resistance adjusting layer and the second engaging projection is provided to extend from the first engaging projection along the axial direction of the electric resistance adjusting layer, wherein the first engaging opening and the second engaging opening are provided in each of the space holding members, and wherein the first engaging member is inserted into the first engaging opening and the second engaging projection is inserted into the second engaging opening.

3. The conductive member according to claim 2, wherein the first and second engaging projections are press-fitted in the first and second engaging openings, respectively.

4. The conductive member according to claim 2, wherein the first and second engaging projections are inserted into the first and second engaging openings, respectively, and fixed through an adhesive.

5. The conductive member according to claim 1, wherein each of the space holding members has a ring-like shape.

6. The conductive member according to claim 1, wherein the conductive member comprises an electrification roller.

7. The conductive member according to claim 6, wherein the contacted member comprises a photoconductor drum to which the electrification roller contacts.

8. The conductive member according to claim 1, wherein at least contacting portions of the space holding members with the contacted member are formed from an electrical insulation resin.

9. The conductive member according to claim 1, wherein a volume resistivity value of each of the space holding members is $10^{13}\Omega$cm or more.

10. The conductive member according to claim 1, wherein a volume resistivity value of the electric resistance adjusting layer is in a range of $10^{6}$ to $10^{9}\Omega$cm.

11. The conductive member according to claim 1, wherein the external diameter of the each of the space holding members is set to be larger than that of the electric resistance adjusting layer so that a gap is established between outer peripheral surfaces of the electric resistance adjusting layer and the contacted member when an outer peripheral surface of each of the space holding members contacts with the contacted member.

12. The conductive member according to claim 1, wherein a surface layer is provided on the electric resistance adjusting layer.

13. The conductive member according to claim 12, wherein a volume resistivity value of the surface layer is set to be larger than that of the electric resistance adjusting layer.

14. The conductive member according to claim 1, wherein the conductive member comprises a transcription roller.

15. A process cartridge comprising the conductive member according to claim 1.

16. An image forming apparatus comprising the process cartridge according to claim 15.

* * * * *